United States Patent [19]

Weigert

[11] Patent Number: 4,823,243

[45] Date of Patent: Apr. 18, 1989

[54] MINIATURE SPOTLIGHT WITH EXTREMELY VARIABLE EXIT ANGLE AND CONSTANT EVEN FIELD OF ILLUMINATION

[75] Inventor: Dedo Weigert, Munich, Fed. Rep. of Germany

[73] Assignee: Dedotec optronische und mechanische Systeme GmbH, Fed. Rep. of Germany

[21] Appl. No.: 89,548

[22] Filed: Aug. 26, 1987

[30] Foreign Application Priority Data

Aug. 26, 1986 [DE] Fed. Rep. of Germany ..... 3628875

[51] Int. Cl.[4] ..... F21V 13/02

[52] U.S. Cl. ..... 362/281; 362/285; 362/286; 362/294; 362/307; 362/326; 362/373

[58] Field of Search ..... 362/277, 280, 281, 285, 362/286, 288, 289, 307, 373, 326, 293, 294, 264, 268

[56] References Cited

U.S. PATENT DOCUMENTS

| | | | |
|---|---|---|---|
| 1,338,818 | 5/1920 | Dennington | 362/285 X |
| 2,307,302 | 1/1943 | Richardson | 362/373 |
| 3,270,196 | 8/1966 | Foley | 362/285 |
| 3,455,622 | 7/1969 | Cooper | 362/293 X |
| 4,462,067 | 7/1984 | Altman | 362/285 X |
| 4,495,549 | 1/1985 | Carlson et al. | 362/293 X |
| 4,519,020 | 5/1985 | Little | 362/268 |

FOREIGN PATENT DOCUMENTS

| | | | |
|---|---|---|---|
| 1115656 | 10/1961 | Fed. Rep. of Germany . | |
| 1804981 | 6/1970 | Fed. Rep. of Germany . | |
| 7344418 | 7/1974 | Fed. Rep. of Germany . | |
| 3207926 | 9/1983 | Fed. Rep. of Germany | 362/285 |
| 1102036 | 4/1955 | France | 362/285 |
| 262898 | 12/1926 | United Kingdom | 362/307 |

OTHER PUBLICATIONS

H. H. Schroeder and A. F. Turner, "A Commercial Cold Reflector" Journal of the SMPTE, vol. 69, May 1960.

*Primary Examiner*—Samuel Scott
*Assistant Examiner*—Carl D. Price
*Attorney, Agent, or Firm*—Wegner & Bretschneider

[57] ABSTRACT

A miniature spotlight for short distance illumination and optical effects producing an extreme variable exit angle of illumination and maintaining a constant even field of illumination is of such complex configuration that the use within a stage set or hidden behind small objects will be suitable for photographic and cinematographic close-up settings.

4 Claims, 1 Drawing Sheet

MINIATURE SPOTLIGHT WITH EXTREMELY VARIABLE EXIT ANGLE AND CONSTANT EVEN FIELD OF ILLUMINATION

BACKGROUND OF THE INVENTION

The invention refers to a miniature spotlamp for short distance illumination effects, as commonly needed in the photographic and cinematographic profession, especially for an increase of the general illumination of small parts of a set, to balance color divergences or to produce local shadow effects. For these short distance illumination effects, especially within very limited space and operational conditions, some compact and simple spotlights have been produced in past years using in general miniature spotlamps with built-in reflectors or fresnel lenses. These spotlights, however, are of single purpose characteristics and relatively poor performance and their variance in the optical output angle—if any—is of low quality and they cannot be considered a qualified optical instrument for illumination.

The instant invention does not only eliminate said deficiencies of known products, but also will be able to meet recent requirements of the modern sophisticated photographic and cinematographic industry, using the combined experiences of modern optical and thermodynamic science and manufacturing methods to produce results which are met in no way by any previous equipment in this field, in particular with Fresnel lenses or with parabolic or elliptic reflectors. The invention also does not compare with the functional specifications of the common stage lights, neither in regard to the optical performance nor regarding the stringent requirements of the thermodynamic and light scatter condition and since stage lights are under any circumstances placed at a far distance from the stage set and are not concerned about light tightness, low-weight and heat removal problems and several specific design features of the invention are not of any concern in the design of common stage lights. On the other hand, the performance of the invention regarding the variability of the illumination output angle (120° to 2°) and the possibility to place this miniature spotlight very close to or even within the stage setting makes it not comparable with common stagelights and many of the simple and optically insufficient small spot lamps. In summary, it has to be emphasized that only with the combination of the optical, thermodynamic and mechanical features of the invention a performance of the wanted qualification could be established.

DETAILED DESCRIPTION OF THE DRAWINGS

Figure 1:
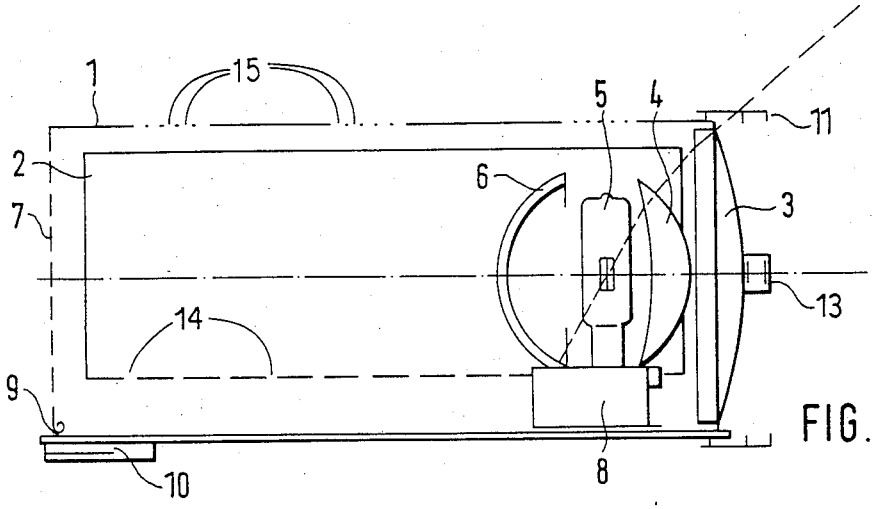
FIG. 1 is a section of the invention with the lamp slide in close front position emitting the maximum exit angle of illumination.

In the following description the parts are referred to as follows:

1. Outer jacket of housing
2. Inner jacket of housing
3. Exchangeable front lens
4. Special aspheric meniscus lens
5. Low voltage filament bulb
6. Dichroic reflector
7. Perforated rear cover plate
8. Slide for the bulb and optics
9. Base plate of housing
10. Connection clip for holders for the miniature spotlamp
11. Holding clamps for optical attachments
12. Multiple circuit transformer

DESCRIPTION OF THE INVENTION

The system and design of the invention is based on the requirements of sophisticated needs and adaptations within the professional photographic and cinematographic profession under stringent requirements in regard to minimum weight and size, low heat emission and easy field operation. These requirements are met as explained as follows and in reference to the parts of the drawings.

Figure 2:
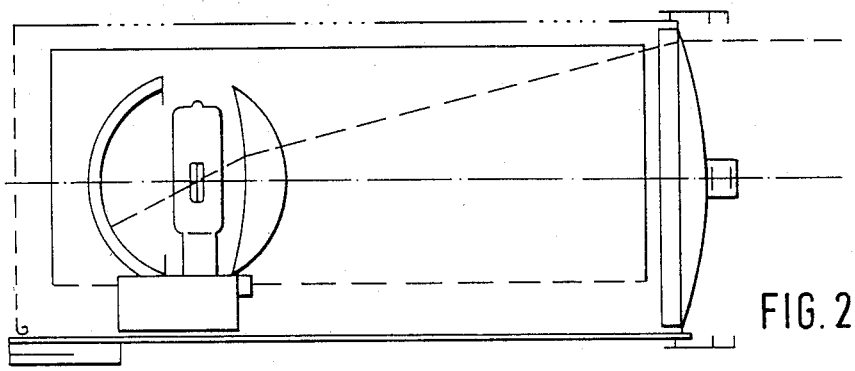
FIG. 2 is a similar section with the lamp slide in a rear position producing a near parallel angle of incidence of the light ray.

In FIG. 1, parts no. 4, 5 and 6, which are mounted within outer jacket 1 and inner jacket 2 of a housing and adjusted according to the optical axis, are producing a conical emission with maximum efficiency towards exchangeable front lens 3. The inner and outer jacket have ventilation holes 14, 15, respectively, arranged so that light cannot leak from the housing. A perforated rear cover 7 permits ventilation of heat from the housing. The dichroic reflector 6 is adjusted superimposing the filament of low voltage filament bulb 5 in such a way that the remaining tangential reduction of the emission of the bulb is eliminated in connection with the meniscus 4. The meniscus itself at the inside surface is crystalline etched (in a manner not shown) in such a way that the diffusion will eliminate the image of the filament wires without reducing the emission of the light. The field lens 3 is defined in such a manner that the focussing point of the lens will be identical with the nodal point of the combination 4, 5, 6 at the position as in FIG. 2 and therefore producing a parallel ray of light and, at a position as in FIG. 1, will be at the maximum angular point.

Figure 3:
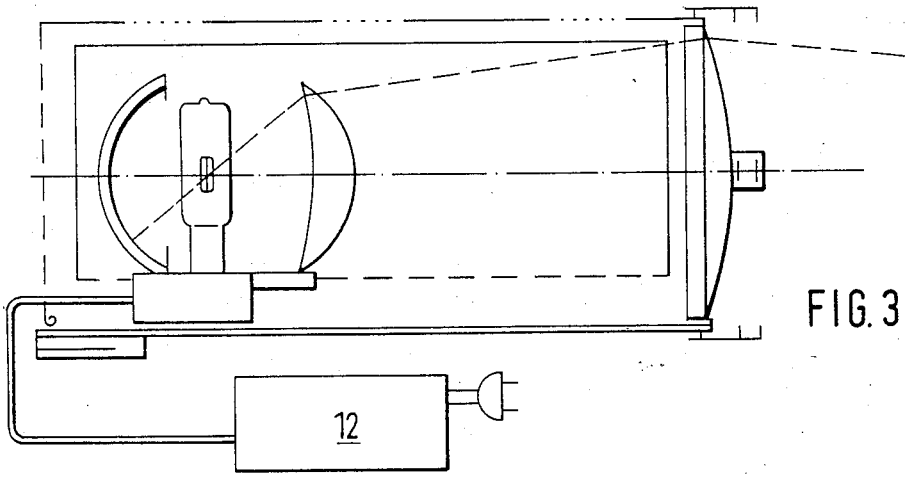
FIG. 3 is a section with the lamp slide at an extreme rear position and the holder of the meniscus lens being moved to an extended distance from the bulb.

To hold the efficiency of the illumination unit toward the front lens at a high level during the motion toward the rear of the housing (at 2) the meniscus lens 4 is moving away from the bulb 5 to receive a larger usable amount of light from the bulb as shown in FIG. 3. A slide 8 for holding the optical assembly (bulb, reflector and lens) is movable along base plate 9. Additionally, lens 4 can be moved along the slide relative to bulb 5, preferably through the use of step notches (not shown), as can be seen by a comparison of FIGS. 2 and 3.

In this way the ray emerging from front lens 3 will finally produce a small spot of light close to the exit port.

The removable and exchangeable field lens 3 will provide further extended optical features of the spotlight as also will be accomplished by preset adapters held at position 13 which can be widely used in view of the cool condition of the light emission of the unit caused by the efficient ventilation of the housing and heat transmitting and/or heat reflecting coatings of the optical components, such as on lens 3. Based on the design features as explained above and under consideration that for said short distance operations bulbs of more than 100 Watts approximately will not be useful the resulting size and weight of the unit can remain extremely small and therefore it will be possible to use it within a very tight space and operational conditions and it could also be concealed behind small objects. To obtain complicated and even superimposing illumination effects and to produce shadowless lighting this lamp is preferably operated in a set of four and with four independent low voltage (12 V) outlets of a power transformer 12 with independent rheostats for the adjustment of the light intensity of each bulb.

What is claimed is:

1. A miniature spotlight for producing a uniform beam for use in illuminating small parts of a stage at close distances, said spotlight having an extremely extended and variable optical exit angle from 2° to 120°, said spotlight comprising:

a housing having an inner and an outer jacket and a base plate;

an exchangeable field lens removably attached to the front exit side of said housing;

a movable slide mounted on said base plate within said housing;

an optical assembly mounted on said slide, said optical assembly including a front aspheric meniscus lens, a rear dichoric reflector and a low voltage filament bulb disposed between said meniscus lens and said reflector, said meniscus lens being movable on said slide relative to said bulb and said optical assembly being movable relative to said field lens.

2. A miniature spotlight as in claim 1, wherein said inner jacket and said outer jacket have a plurality of ventilation holes, said holes arranged so that substantially no light can leak from said housing.

3. A miniature spotlight as in claim 1 further comprising a ventilated rear cover plate fixed to the rear of said housing.

4. A miniature spotlight as in claim 1 wherein said field lens has a heat reflecting and light transmitting coating on the inner surface thereof.

* * * * *